US006005181A

United States Patent [19]

Adams et al.

[11] Patent Number: 6,005,181

[45] Date of Patent: Dec. 21, 1999

[54] ELECTRONIC MUSICAL INSTRUMENT

[75] Inventors: Robert L. Adams, Stanford; Michael Brook, Los Angeles; John Eichenseer, San Francisco; Mark Goldstein, Menlo Park; Geoff Smith, Palo Alto, all of Calif.

[73] Assignee: Interval Research Corporation, Palo Alto, Calif.

[21] Appl. No.: 09/056,388

[22] Filed: Apr. 7, 1998

[51] Int. Cl.[6] ..... G10H 3/14

[52] U.S. Cl. ..... 84/734; 84/735; 84/737

[58] Field of Search ..... 84/734, 735, 737

[56] References Cited

U.S. PATENT DOCUMENTS

| | | | |
|---|---|---|---|
| D. 258,216 | 2/1981 | Eventoff | D17/99 |
| D. 351,612 | 10/1994 | Eventoff | D17/1 |
| 3,626,078 | 12/1971 | Hamamatsu-shi | 84/1.24 |
| 3,742,114 | 6/1973 | Barkan | 84/1.16 |
| 3,787,602 | 1/1974 | Okudaira | 84/1.24 |
| 3,965,789 | 6/1976 | Pearlman | 84/1.24 |
| 4,235,141 | 11/1980 | Eventoff | 84/1.01 |
| 4,257,305 | 3/1981 | Friend et al. | 84/1.24 |
| 4,268,815 | 5/1981 | Eventoff et al. | 338/69 |
| 4,276,538 | 6/1981 | Eventoff et al. | 338/69 |
| 4,301,337 | 11/1981 | Eventoff | 200/5 A |
| 4,314,228 | 2/1982 | Eventoff | 338/114 |
| 4,315,238 | 2/1982 | Eventoff | 338/99 |
| 4,451,714 | 5/1984 | Eventoff | 200/5 A |
| 4,489,302 | 12/1984 | Eventoff | 338/99 |
| 4,739,299 | 4/1988 | Eventoff et al. | 338/99 |
| 4,781,097 | 11/1988 | Uchiyama et al. | 84/1.13 |
| 4,810,992 | 3/1989 | Eventoff | 338/99 |
| 4,816,200 | 3/1989 | Stecher et al. | 264/59 |
| 5,231,488 | 7/1993 | Mohrbacher et al. | 358/139 |
| 5,266,737 | 11/1993 | Okamoto | 84/626 |
| 5,726,372 | 3/1998 | Eventoff et al. | 84/609 |
| B1 4,314,227 | 1/1989 | Eventoff | 338/99 |

OTHER PUBLICATIONS

Paradisco, "Electronic Music: New Ways to Play", IEEE Spectrum, Dec. 1997, pp. 18–30.

Author Unknown, "StarrLabs MIDI Controllers", http://catalog.com/starrlab/xtop/htm Dec. 14, 1997.

Author Unknown, "Korg On–Line Prophecy Solo Synthesizer", Copyright KORG© USA, Inc. 1997, Net Haven, a Division of Computer Associates, http://www.korg.com/prophecy1.htm.

*Primary Examiner*—Jeffrey Donels

*Attorney, Agent, or Firm*—Pennie & Edmonds LLP

[57] ABSTRACT

A control instrument for a system for generating acoustic output which includes a processor for receiving user input signals and control the acoustic output in response to the user input signals. The control instrument includes an instrument body, and at least one sensor element carried by the instrument body. The sensor element generates user input signals upon tactile actuation of the sensor element by a user. The user input signals indicate the location of contact and amount of force applied to the sensor element by the user. A music synthesis system and a sound processing system each including the control instrument are also provided.

27 Claims, 4 Drawing Sheets

| CONTINUOUSLY VARIABLE CONTROL PARAMETER | SENSOR SIGNAL |
|---|---|
| Pressure | FRC1 |
| Embrochure | LOC2 |
| Tonguing | LOC2 |
| Breath Noise | FRC2 |
| Scream | -- |
| Throat Formant | -- |
| Dampening | FRC3 |
| Absorption | FRC3 |
| Harmonic Enhancer | -- |
| Dynamic Filter | -- |
| Amplitude | -- |
| Vibrato | -- |
| Growl | -- |
| Pitch | LOC3 |

FIG. 3

ELECTRONIC MUSICAL INSTRUMENT

BRIEF DESCRIPTION OF THE INVENTION

The present invention relates in general to an electronic musical instrument and, more particularly, to a control instrument for generating user input signals for a music synthesis system.

BACKGROUND OF THE INVENTION

Electronic music instruments including keys, strings or other input devices and synthesizer systems for converting the user input into electrical signals and producing music and other acoustic signals in response to the electrical signals are well known. The instruments, which are typically patterned after traditional instruments, take many forms such as electronic keyboards, electronic guitars, electronic drums and the like.

The main component of an electronic keyboard is a bank of keys which resemble the keys of a piano. The keyboard also typically includes a number of buttons for selecting various options and sliders and/or wheels which may be used to control various parameters of the sound produced by the synthesizer. The keys are used to generate two different signals—a MIDI note-on event when the key is pressed which sends a note and velocity data pair to the synthesizer and a MIDI note-off event when the key is released. The keys provide only limited control over other parameters such as timbre, pitch and tone quality, the control being restricted to altertouch signals produced by the application of additional pressure on a depressed key. The aftertouch signal can occur per-note or across all notes, but can only occur when at least one key is depressed and must be linked to the note number of the active keys. Instead, some degree of control over the other parameters is provided by separately operating the sliders or wheels of the keyboard. However, even when slides or wheels are used, the amount of user control over the resulting sound parameters is considerably less than the control experienced with traditional instruments. Moreover, the number of slides, buttons and keys which can be simultaneously manipulated by the user is limited, restricting the number of different parameters which may be controlled at any instant through the use of wheels or slides. Simultaneously actuating the selected keys and manipulating the sliders or wheels can be awkward and difficult, further reducing the realism of the experience.

Electric and electronic guitars typically include strings which are actuated by the user to generate notes. Knobs or other controls are provided to control volume and tone. As with the electronic keyboard, the amount of control provided over various sound parameters is limited.

Electronic percussion instruments typically include one or more drum pads which are struck using traditional drum techniques. Sensors detect the force of impact with the generated signals being used by the synthesizer to produce the sound. Some later versions include sensors which also detect the location of contact, with contact in different zones of the drum pad producing different sounds. Thus, considerable control is provided over the resulting percussion sounds. However, the number of parameters which contribute to the sound of percussion instruments is more limited than the variable sound parameters of keyboards and string and wind instruments.

One new type of music synthesizer uses digital physical modeling to produce the sound, providing more sonic realism. An example of such a synthesizer is the Yamaha VLI-M Virtual Tone Generator (Yamaha and VLI are trademarks of Yamaha). In addition to improved sonic realism, greater parametric control over the resulting sound is available with the digital physical modeling system. However, the limitations of the existing electronic instruments in receiving user input prevent the user from taking advantage of the increased amount of control which is available with the new synthesizer.

An electronic instrument which allows the user to create and/or control sounds while simultaneously and continuously modifying many of a music synthesizer's parameters is desirable. An instrument which takes advantage of the greater flexibility over parameter control offered by devices such as a digital physical modeling synthesizer or a sophisticated sound processor is also desirable. Similarly, an electronic instrument which simulates the realistic music experience of traditional music instruments is desirable.

OBJECTS AND SUMMARY OF THE INVENTION

It is a primary object of the present invention to provide an electronic instrument which allows the user to create and/or control musical sounds and other acoustic effects.

It is further object of the present invention to provide an electric instrument which allows the user to simultaneously and continuously modify many of the parameters of the created sound.

It is another object of the present invention to provide an electrical instrument which utilizes a greater amount of the parameter control available with a digital physical modeling synthesizer.

It is yet another object of the present invention to provide an electrical instrument which provides the user with a realistic playing experience.

A more general object of the present invention is to provide an electrical instrument which is easy to master without extensive training and practice, providing inexperienced users with the pleasure of creating music, and which is comfortable to handle and play.

In summary, this invention provides an electrical musical instrument which may be used to continuously and simultaneously modify various parameters of an acoustic output. The instrument generally includes an instrument body, and at least one sensor element carried by the instrument body. The sensor element generates user input signals upon tactile actuation of the sensor element by a user. The user input signals indicate the location at which the sensor element is contacted and the amount of force applied to the sensor element by the user. The user input signals are transmitted to a processor which receives the user input signals and controls the acoustic output in response to the user input signals.

The invention is also directed toward a synthesis system and a sound processing system each incorporating the control instrument. Each system includes a control instrument including an instrument body and at least one sensor element carried by the instrument body which generates user input signals upon tactile actuation of the sensor element by a user, with the user input signal indicating the location at which the sensor element is contacted and the amount of force applied to the sensor element. The music synthesis system includes a processor coupled to the sensor element for receiving the user input signals and producing music synthesis signals, a synthesizer coupled to the processor for receiving the music synthesis signals and generating audible output signals in response to the music synthesis signals, and at least one audio speaker coupled to the synthesizer for converting the audio frequency output signal into audible music. The sound processing system includes a processor coupled to the sensor element for receiving the user input signals and producing control signals, an audio source, and a signal processor coupled to the processor and the audio source for receiving the input from the audio source and the control signals and generating audible output signals in response to the control signals.

Additional objects and features of the invention will be more readily apparent from the following detailed description and appended claims when taken in conjunction with the drawings.

BRIEF DESCRIPTION OF THE DRAWINGS

FIG. 3 shows a table illustrating one example of the signal to control parameter assignment.

DETAILED DESCRIPTION OF THE INVENTION

Figure 1:
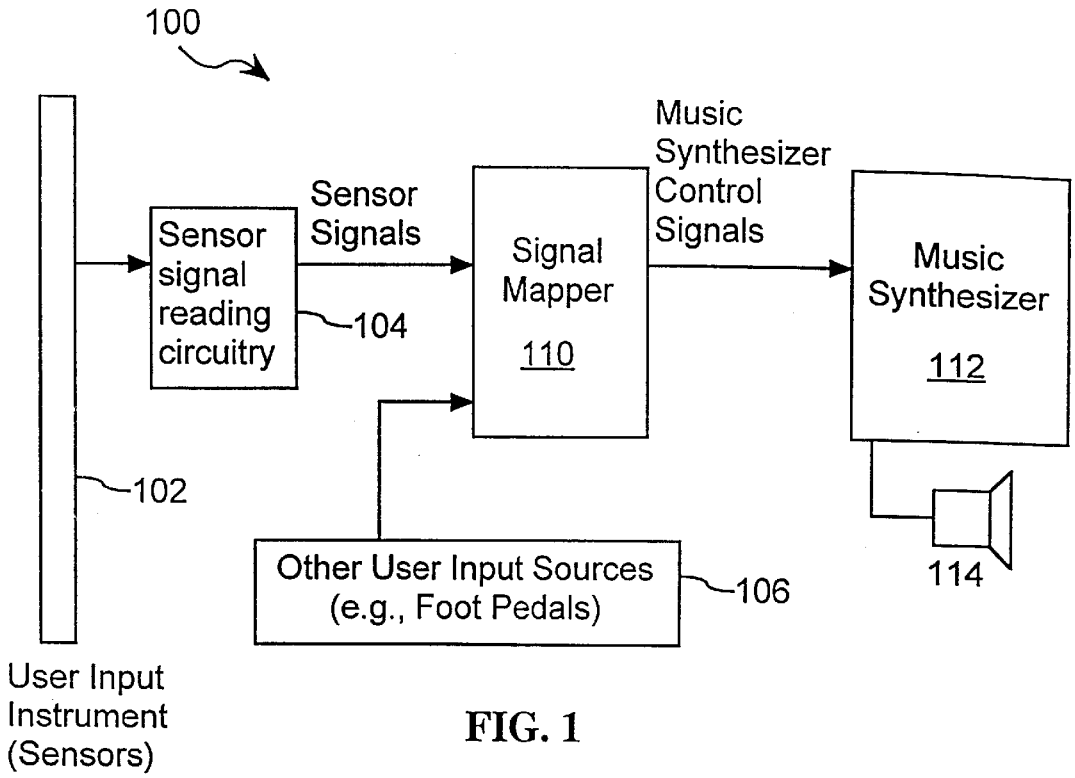
FIG. 1 is a block diagram of a music synthesizer system in accordance with the present invention.

Reference will now be made in detail to the preferred embodiment of the invention, which is illustrated in the accompanying figures. Turning now to the drawings, wherein like components are designated by like reference numerals throughout the various figures, attention is directed to FIG. 1.

FIG. 1 shows an example of a music synthesis system 100 incorporating a control instrument 102 in accordance with the present invention. As is discussed in more detail below, the control instrument 102 generates user input signals upon tactile actuation of the instrument 102 by the user. The user input signals generated by the control instrument 102 are read by sensor reading circuitry 104. As shown in FIG. 1, secondary input signal sources 106, such as foot pedals and the like, may be incorporated in the music synthesis system if desired. The secondary input signal sources 106 are an optional feature of the music synthesis system 100, and are not required. A signal mapper 110 maps the user input signals generated by the control instrument 102 into music synthesis control signals. The music control signals are sent to a music synthesizer 112 which generates an audio frequency output signal in response to the control signals received from the signal mapper 110. The system also includes one or more audio speakers 114 for converting the audio frequency output signal into audible music (i.e., acoustic energy).

Figure 2:
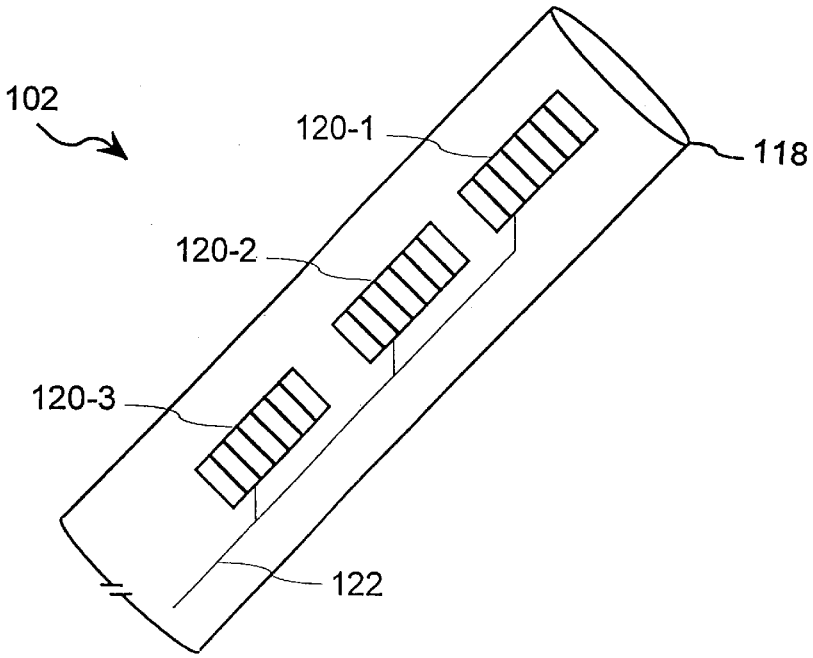
FIG. 2 is a pictorial view of a control instrument in accordance with the present invention.

As shown particularly in FIG. 2, the control instrument 102 includes an instrument body 118. The instrument body 118 of the present embodiment is an elongate, rod-shaped member. The instrument body 118 is preferably formed of wood, which feels comfortable in the users hands. However, other materials such as metals and metal alloys may be used instead of wood. The size of the instrument body 118 is subject to wide variation, although the instrument body 118 is preferably of a size and shape such that it is comfortable to hold and operate. In the illustrated embodiment, the instrument body 118 has a length of about 60 inches and a diameter of about 1.75 inches.

A plurality of sensor elements 120 are carried by the instrument body 118. In the embodiment shown in FIG. 2, the control instrument 102 includes three sensor elements 120-1, 120-2 and 120-3. However, it is to be understood that a greater or lesser number of sensor elements may be employed. The signals generated by the sensor elements 120 are transmitted to the signal mapper 110 (FIG. 1) via a cable 122. The sensor elements 120-1, 120-2 and 120-3 are force sensitive resistors (FSRs) which detect the amount of pressure applied to the sensor element by the user. When a force is applied to the surface of the FSR, a decrease in resistance is created with the resistance decreasing as the amount of force applied to the surface increases. The FSRs used in the present embodiment are linear potentiometer FSRs which detect both the location of contact as well as the amount of force applied to the sensor element.

The FSRs employed in the illustrated embodiment are particularly usefull when the user plays the instrument through tactile input, such as by touching the sensor elements with his fingers and varying this touch to modify the created sound as discussed in more detail below. However, it is to be understood that other multidimensional sensors may be used in place of the FSRs. Instead of responding to touch, the sensor elements of the control instrument could receive input in other forms. For example, the sensors may receive input based upon the position of the control instrument in space or the instrument may function in a manner similar to wind instruments with the sensor elements detecting breath pressure, tongue pressure and position, and the like. The FSRs exhibit a sensitivity which is particularly suitable for detecting subtle variations in the way the sensor elements 120 is touched by the fingers of the user. However, it is to be understood that the sensor elements may be actuated by a device such as a stick or bow instead of the user's fingers.

The user plays the instrument by manually actuating the sensor elements 120 in the desired manner. The manner in which the control instrument 102 is played is subject to considerable variation. In general, with the control instrument 102 of the embodiment of FIG. 2, input is received from the user when (1) one of the sensor elements 120 are touched, (2) the user's finger is moved along the sensor element, (3) the amount of pressure applied to the sensor element is varied, and (4) the user's finger is removed, releasing the sensor element. The control instrument 102 is played using these basic actions to activate the sensor elements 120 to achieve the desired effect. The effect produced by each of these movements depends upon the how the system 100 is configured.

When the user touches the sensor element 120, the sensor element generates two signals, one corresponding to the force of contact, the FRC signal, and the other corresponding to the location of contact, the LOC signal. The signals are read by the circuitry 104 and sent to the signal mapper 110, which maps the user input signals into control parameters for the music synthesizer and generates MIDI signals that are sent to the music synthesizer 112. The MIDI signals specify the control parameter values. One aspect of the music synthesis system 100 of this invention is that the user may select which control parameters are controlled by each sensor element 120.

Control parameters of the sound generated by the music synthesizer include note number and velocity as well as the physical model parameters used in the synthesis of wind instruments. The control parameters associated with wind instruments include: pressure, embrochure, tonguing, breath noise, scream, throat formant, dampening, absorption, harmonic filter, dynamic filter, amplitude, vibrato, growl, and pitch. Generally, the note number and velocity are controlled by input signals that accompany a note-on gesture. The note-on (and note-off) gesture is defined as a function of an input signal. The music synthesizer generates sound when a MIDI note-on event is received. The signal determining the note-on gesture need not be the same as the signal controlling note number or velocity.

As is well known in the synthesizer art, for each voice of the music synthesizer, sound is generated when a MIDI note-on event is generated. The MIDI note-on event indirectly specifies a pitch value by specifying a predefined MIDI note number, and also specifies a velocity value. The amplitude or a vector of amplitude values over the duration of the note is usually determined by the velocity parameter. However, since the velocity parameter is the "velocity" of the action which created the note-on event, the velocity may not be used to control the amplitude throughout the duration of the note.

With the present invention, the control parameters associated with wind instruments, including the amplitude of the note, may be continuously controlled by the user, whether or not note-on events have occurred. For example, parameter transmission occurs every 10–15 msec in the present embodiment of the invention. This feature of the invention, controlling various parameters during the duration of the note, is referred to as the ability to continuously vary a signal or parameter. A signal or parameter is updated "continuously" if it is updated in response to the user's actions more frequently than note-on events are generated. In other words, the "continuously" updated control parameters are updated whenever the corresponding sensor signals vary in value, regardless of whether or not those sensor signal value changes cause note-on events to be generated.

With most synthesizers available in the art, as is well known in the field, the amplitude control parameter is a value between 0 and 1. Typically, the amplitude control parameter is multiplied (inside the music synthesizer) by the velocity value specified in the MIDI note-on event (although other mathematic functions could be applied to as to combine the velocity and amplitude values). As a result, the amplitude of the note generated is a function of both the note-on velocity, which stays constant until there is a corresponding MIDI note-off event, and the amplitude control signal, which can vary continuously as a corresponding sensor signal generated by the user varies in value.

As known in the synthesizer art, the pitch control parameter is used in an additive manner to modify the pitch specified in the MIDI note-on event for each music synthesizer voice. The pitch control parameter has a value that is preferably scaled in "cents," where each cent is equal to 0.01 of a half note step (i.e., there are 1200 cents in an octave). For example, if the pitch value specified by a MIDI note-on event is 440 Hz and pitch control parameter is equal to 12 cents, the music synthesizer will generate a sound having a pitch that is twelve one-hundredths (0.12) of a half step above 440 Hz (i.e., about 443.06 Hz).

Each of these control parameters may be assigned to either the LOC signal or FRC signal of one of the sensor elements 120. FIG. 3 illustrates one possible configuration. With the present embodiment, each control parameter may be controlled by only one signal from one of the sensor elements 102. However, the user may select which sensor element 120 and which signal (FRC or LOC) controls the parameter. As shown in FIG. 3, with the three sensor elements 120, the FRC and LOC signals created by each sensor are assigned to more than one of the control parameters. Thus, by selectively actuating the three sensor elements 120, the user may continuously control fourteen parameters without the use of awkward switches, wheels or sliders. The gestures used to generate the note are essentially the same as the gestures used to continuously modify the note, allowing the control instrument 102 to be easily and comfortably played by the user. By tailoring the assignment of control parameters to sensor signals, the user may configure the instrument to meet his individual style. Each of the control parameters may be continuously updated in response to changes in the corresponding signal. Alternatively, the user may adjust the set-up configuration so that one or more control parameters are not assigned to any LOC or FRC signal and are therefore unaffected by the player's action.

Assignment of the control parameters to the signals generated by the sensor elements 120 is accomplished by the signal mapper 110. In the preferred form of the invention, the signal mapper 110 allows the user to select the control parameter to signal source assignments. However, it is to be understood that in other modification of the invention the control instrument may be used with a signal mapper in which the relationship between the signals and the control parameters may not be changed. The signal mapper 110 is described in further detail in co-pending application, Ser. No. 09/056,354, filed Apr. 7, 1998, entitled System and Method for Controlling a Music Synthesizer, which is incorporated by reference herein. However, it is to be understood that the control instrument of this invention may be used with other signal mappers. Generally, the signal mapper 110 maps the sensor signals, including the signals received from any secondary input sources 106, into control signals according to the selected assignment configuration. In the illustrated embodiment, the signal mapper 110 converts all changes in the sensor signals into MIDI signals that are sent to the music synthesizer 112. These MIDI signal specify control parameter values. However, it is to be understood that the control signals may be encoded using a standard or methodology other than MIDI.

The control signals generated by the signal mapper 110 are sent to the music synthesizer, which produces music or other acoustic sounds in response to the control signals. In the present embodiment of the invention, the music synthesizer 112 is a Yamaha VL1-M Virtual Tone Generator (Yamaha and VL1 are trademarks of Yamaha). However, it is to be understood that other music synthesizers may be used in the music synthesis system 100. Preferably, the music synthesizers used with the system 110 are capable of receiving continuously changing control parameters in real time.

Figure 4:
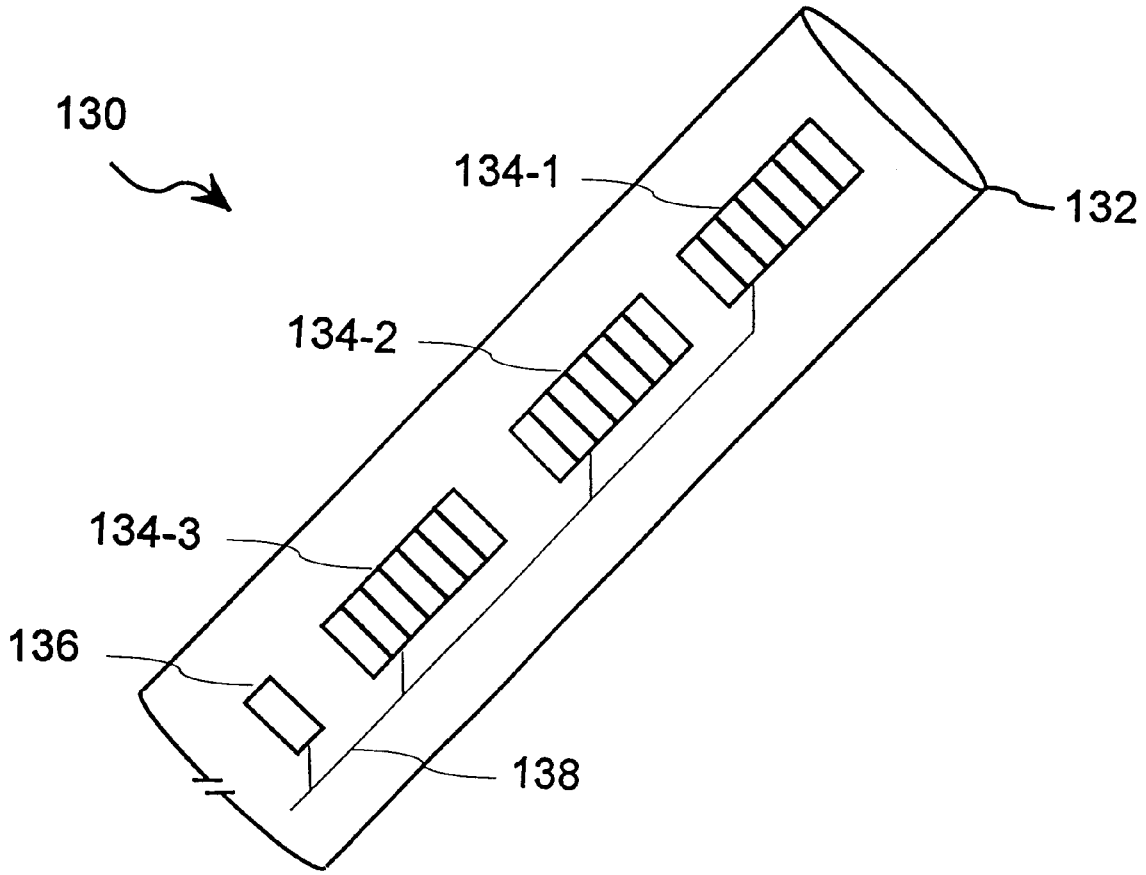
FIG. 4 is a pictorial view of another embodiment of a control instrument of in accordance with the present invention.

FIG. 4 shows another embodiment of a control instrument 130 in accordance with this invention. The instrument 130 generally includes an instrument body 132 and a plurality of sensors 134 carried by the instrument body 132. The instrument body 132 and sensors 134 are substantially the same as the instrument body 118 and sensors 120, and are therefore not described in detail. The instrument body 132 also includes a sensor 136. The sensor 136 may be in the form of a drum sensor, such as a piezo-electric transducer, which generates a signal when the user taps or hits the instrument body. The drum sensor detects a strike of sufficient force on the instrument body 132, and sends a signal transmitting a single message with the strength of the hit. Alternatively, the sensor 136 may be an accelerometer which senses the acceleration caused by the actuation of the sensors 134 by the user. Other types of sensors or strain gauges which sense the bending of the rod as a control parameter may also be employed.

The instrument body 132 may include more than one sensor 136, the multiple sensors 136 being a mixture of different types of sensors such as one or more drum sensors and one or more accelerometers, or the multiple sensors 136 may all be of the same type. The sensor signals generated by the sensors 134, 136 are transmitted via a communications cable 138 to the signal mapper.

Figure 5:
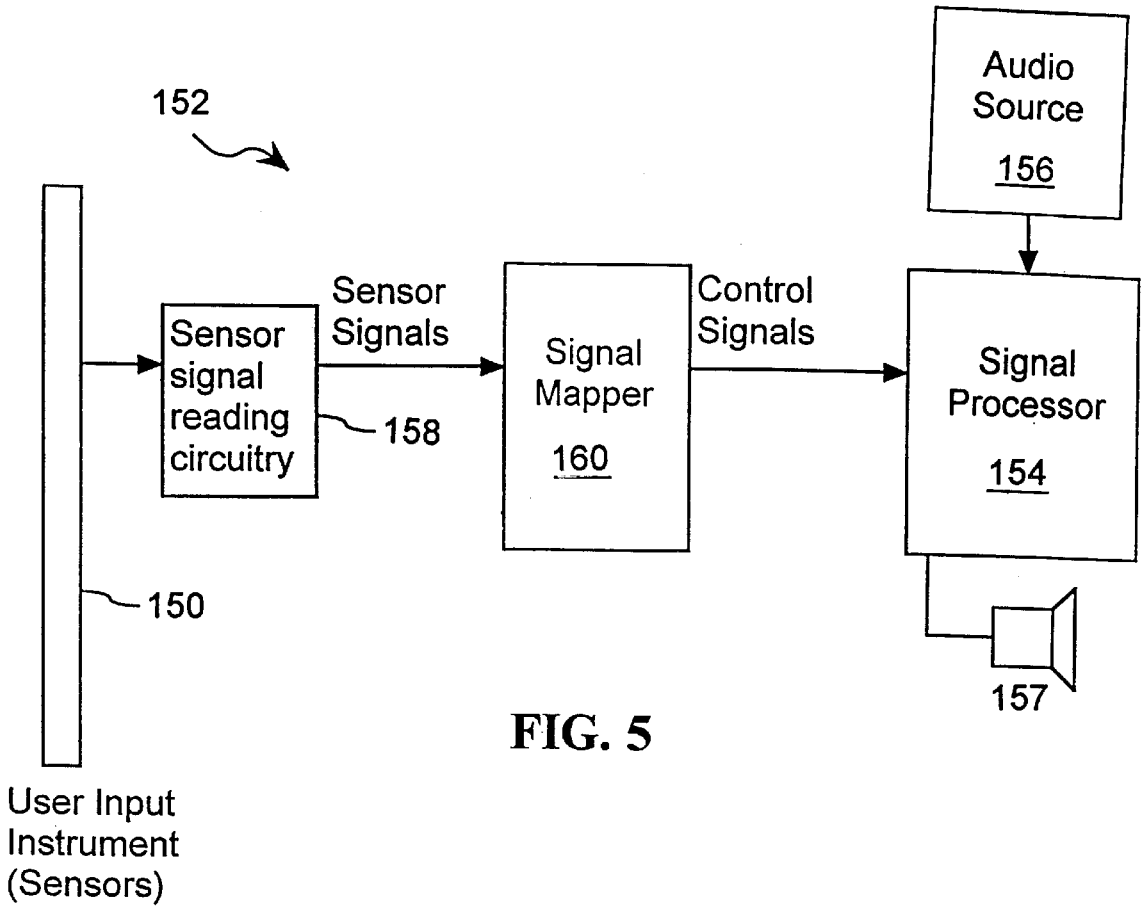
FIG. 5 is a block diagram of a sound processor system in accordance with the present invention.
Figure 6:
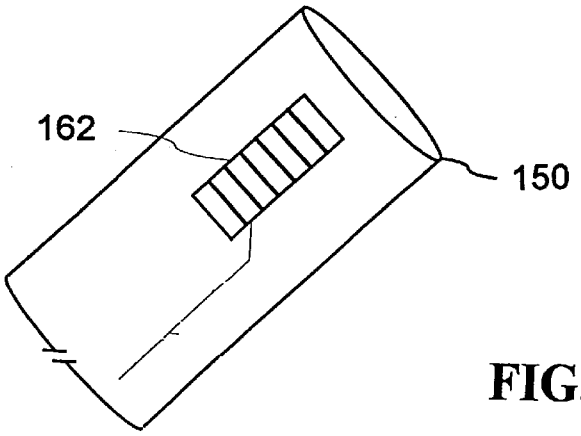
FIG. 6 is a pictorial view of a control instrument.

FIGS. 5 and 6 show an embodiment of the present invention in which the control instrument 150 is used with a sound processing system 152. With its ability to provide continuous control over multiple parameters control, the control instrument of this invention is particularly suitable for use in with sound processors, examples of which include, but are not limited to, filters, ring modulators, vocoders, etc. The sound processing system 152 generally includes a signal processor 154 which receives input from an audio source 156. The signal processor is coupled to an output device 157, such as audio speakers as in the music synthesis system. The type of audio source 156 employed is subject to considerable variation. The control instrument 150 generates user input signals which are read by sensor reading circuitry 158. A signal mapper 160 maps the user input signals generated by the control instrument 150 into continuous control signals which are used to control the signal processor 154.

As with the previously described embodiments, the control instrument 150 includes at least one sensor element 162 which are used to generate the user input signals. In the embodiment of the control instrument 150 shown in FIG. 6, only one sensor element 162 is provided. However, it is to be understood that the control instrument 150 may include two or more sensor elements 162. One advantage of using several sensor elements is that the a greater number of parameters may be more conveniently controlled by the user. As with the previous embodiments, the sensor element 162 is an FSR which continuously detects the amount of pressure applied to the sensor element by the user.

The parameters controlled by the control instrument 150 is subject to considerable variation, depending upon the type of sound processor and the type of sound effects program operated by the signal processor 15. Each of the parameters controlled by the control instrument 150 maybe assigned to either the LOC signal or FRC signal of sensor element 162, or one of the sensor elements if several sensor elements 162 are employed. It is to be understood that this assignment is subject to considerable variation depending upon such factors as the configuration of the signal processor 154 and user preference.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best use the invention and various embodiments with various modifications as are suited to the particular use contemplated. It is intended that the scope of the invention be defined by the claims appended hereto and their equivalents.

What is claimed is:

1. A control instrument for a system for generating acoustic output, the system including a processor for receiving user input signals and controlling the acoustic output in response to the user input signals, the control instrument comprising:

an instrument body;

a first sensor element carried by the instrument body, the first sensor element generating first user input signals upon tactile actuation of the first sensor element by a user, the first user input signals indicating the locations at which the first sensor element is contacted and the amount of force applied to the first sensor element by the user at a plurality of intervals during the tactile actuation of the first sensor element; and a second sensor element carried by the instrument body, the second sensor element generating second input signals upon tactile actuation of the second sensor element by the user, the second user input signals indicating the locations at which the second sensor element is contacted at the plurality of intervals;

wherein the first and second sensors are independently position sensitive to tactile actuation.

2. The control instrument of claim 1 in which the instrument body includes ain elongate rod.

3. The control instrument of claim 1 in which the first sensor element is a force sensitive resistor.

4. The control instrument of claim 2, wherein the first and second sensor elements are linearly arranged on the elongate rod.

5. The control instrument of claim 4 in which the secondary sensor element is a drum sensor.

6. The control instrument of claim 4 in which the secondary sensor element is an accelerometer.

7. The control instrument of claim 1, further including a signal mapper that maps the user input signals produced by the first and second sensor elements into music synthesis control parameters for use by a music synthesizer.

8. The control instrument of claim 7 in which the signal mapper maps at least one of the first user input signals produced by the first sensor element into a plurality of different music synthesis control parameters.

9. The control instrument of claim 1 in which the instrument body is an elongate rod.

10. The control instrument of claim 1 wherein the user input signals are periodically updated so as to track changes in the tactile actuation of the first and second sensor elements.

11. A control instrument for a system for generating acoustic output, the system including a processor for receiving user input signals and controlling the acoustic output in response to the user input signals, the control instrument comprising:

an instrument body;

a first sensor element carried by the instrument body, the first element generating first user input signals upon tactile actuation of the first sensor element by a user, the first user input signals indicating the locations at which the first sensor element is contacted and the amount of force applied to the first sensor element by the user at a plurality of intervals during the tactile actuation of the first sensor element; and a second sensor element carried by the instrument body, the second sensor element generating second input signals upon striking of the instrument body by the user with at least a predetermined amount of force.

12. A control instrument for a system for generating acoustic output, the system including a processor for receiving user input signals and controlling the acoustic output in response to the user input signals, said control instrument comprising:

an instrument body comprising an elongate rod; and first and second sensor elements carried by and linearly aligned on the instrument body, the first and second sensor elements generating user input signals upon actuation thereof by a user, each of the user input signals indicating at least one respective physical characteristic of actuation of a respective one of the first and second sensor elements at a plurality of intervals during the actuation of the first and second sensor elements;

wherein the user input signals generated by the first and second sensor elements are periodically updated so as to track changes in the actuation of the first and second sensor elements.

13. A sound processing system comprising:

a control instrument including an instrument body and first and second sensor elements carried by the instrument body, each of the first and second sensor elements generating respective, distinct user input signals upon tactile actuation of the respective sensor elements by a user, the user input signals indicating respective locations at which the respective sensor elements are contacted and amount of force applied to the respective sensor elements by the user at a plurality of intervals during the tactile actuation of the respective sensor elements; wherein the first and second sensor elements are independently sensitive to tactile actuation;

a processor coupled to the sensor element for receiving the user input signals and producing control signals;

an audio source; and a signal processor coupled to the processor and the audio source for receiving the input from the audio source and the control signals and generating audible output signals in response to the control signals.

14. The sound processing system of claim 13, wherein the control instrument includes an elongate rod and the first and second sensor elements are linearly arranged on the elongate rod.

15. A sound processing system comprising:

a control instrument including an instrument body and first and second sensor elements carried by the instrument body, each of the first and second sensor elements generating respective, distinct user input signals upon tactile actuation of the respective sensor elements by a user, the user input signals indicating the respective locations at which the respective sensor elements are contacted by the user at a plurality of intervals during the tactile actuation of the respective sensor elements; wherein the first and second sensor elements are independently sensitive to tactile actuation;

a processor coupled to the sensor element for receiving the user input signals and producing control signals;

an audio source; and a signal processor coupled to the processor and the audio source for receiving the input from the audio source and the control signals and generating audible output signals in response to the control signals.

16. The sound processing system of claim 15, wherein the control instrument includes an elongate rod and the first and second sensor elements are linearly arranged on the elongate rod.

17. The sound processing system of claim 15, wherein the user input signals are periodically updated so as to track changes in the tactile actuation of the first and second sensor elements.

18. A control instrument for a system for generating acoustic output, the system including a processor for receiving user input signals and controlling the acoustic output in response to the user input signals, the control instrument comprising:

an instrument body;

a first sensor element carried by the instrument body, the first sensor element generating first user input signals upon tactile actuation of the first sensor element by a user, the first user input signals indicating the locations at which the first sensor element is contacted and the amount of force applied to the first sensor element by the user at a plurality of intervals during the tactile actuation of the first sensor element; and a second sensor element carried by the instrument body, the second sensor element generating second input signals upon tactile actuation of the second sensor element by the user, the second user input signals indicating the amount of force applied to the second sensor element at the plurality of intervals;

wherein the first and second sensors are independently sensitive to tactile actuation.

19. The control instrument of claim 18 in which the instrument body includes an elongate rod.

20. The control instrument of claim 19, wherein the first and second sensor elements are linearly arranged on the elongate rod.

21. The control instrument of claim 20 in which the secondary sensor element is a drum sensor.

22. The control instrument of claim 20 in which the secondary sensor element is an accelerometer.

23. The control instrument of claim 18 in which the first sensor element is a force sensitive resistor.

24. The control instrument of claim 18, further including a signal mapper that maps the user input signals produced by the first and second sensor elements into music synthesis control parameters for use by a music synthesizer.

25. The control instrument of claim 24 in which the signal mapper maps at least one of the first user input signals produced by the first sensor element into a plurality of different music synthesis control parameters.

26. The control instrument of claim 18 in which the instrument body is an elongate rod.

27. The control instrument of claim 18 wherein the user input signals are periodically updated so as to track changes in the tactile actuation of the first and second sensor elements.

* * * * *